US006736257B2

(12) United States Patent
Steiniger et al.

(10) Patent No.: US 6,736,257 B2
(45) Date of Patent: May 18, 2004

(54) DEVICE AND METHOD FOR TRANSFERRING ARTICLES IN THE TOBACCO-PROCESSING INDUSTRY

(75) Inventors: Wolfgang Steiniger, Geesthacht (DE); Erwin Oesterling, Glinde (DE)

(73) Assignee: Hauni Maschinenbau AG, Hamburg (DE)

( * ) Notice: Subject to any disclaimer, the term of this patent is extended or adjusted under 35 U.S.C. 154(b) by 0 days.

(21) Appl. No.: 10/224,594

(22) Filed: Aug. 21, 2002

(65) Prior Publication Data

US 2003/0051978 A1 Mar. 20, 2003

(30) Foreign Application Priority Data

Aug. 25, 2001 (DE) ..... 101 41 703

(51) Int. Cl.[7] ..... B65G 47/31; B65G 29/00; B65G 47/26; B65G 47/84; B65G 47/34

(52) U.S. Cl. ..... 198/461.1; 198/441; 198/474.1; 198/476.1

(58) Field of Search ..... 198/441, 459.1, 198/459.2, 459.3, 461.1, 471.1, 474.1, 476.1

(56) References Cited

U.S. PATENT DOCUMENTS

| | | | | |
|---|---|---|---|---|
| 2,944,654 A | | 7/1960 | Schubert | |
| 3,010,561 A | | 11/1961 | Ricke | |
| 3,164,243 A | | 1/1965 | Rudszinat et al. | |
| 3,887,059 A | | 6/1975 | Verjux | |
| 4,506,779 A | | 3/1985 | Seragnoli | |
| 4,697,691 A | * | 10/1987 | Zodrow et al. | 198/426 |
| 5,769,205 A | * | 6/1998 | Belvederi et al. | 198/475.1 |
| 6,015,040 A | * | 1/2000 | Goeb et al. | 198/438 |

FOREIGN PATENT DOCUMENTS

| | | |
|---|---|---|
| DE | 31 37 223 C2 | 7/1982 |
| EP | 0 679 343 A2 | 11/1995 |

* cited by examiner

*Primary Examiner*—Gene O. Crawford
(74) *Attorney, Agent, or Firm*—Venable LLP; Robert Kinberg

(57) ABSTRACT

A transfer device is provided for transferring articles from a first conveying device to a second conveying device. The device has a central body and a plurality of transfer element sets attached to the central body. Each transfer element set comprises a plurality of pivoting transfer elements, and each transfer element has a receptacle for receiving an article. The plurality of transfer element sets are arranged around a perimeter of the central body. A first pivoting transfer element and a second pivoting transfer element within one of the transfer element sets are axially offset relative to each other along a common axis.

22 Claims, 4 Drawing Sheets

DEVICE AND METHOD FOR TRANSFERRING ARTICLES IN THE TOBACCO-PROCESSING INDUSTRY

CROSS-REFERENCE TO RELATED APPLICATION

This application claims the priority of German Patent Application No. 101 41 703.9 filed in Germany on Aug. 25, 2001. The disclosure of the above German priority application and the disclosures of each and every U.S. and foreign patent and patent application mentioned herein, are incorporated herein by reference.

BACKGROUND OF THE INVENTION

The invention relates to a device for transferring articles in, for example, the tobacco-processing industry from a first conveying device to a second conveying device. For this, the transfer device comprises transfer elements, which are arranged one behind the other in circumferential direction, which can be pivoted and are respectively provided with a receptacle for each article.

The invention furthermore relates to a method for transferring articles in, for example, the tobacco-processing industry from the receptacles of a first conveying device to the receptacles of a second conveying device by using transfer elements, provided with receptacles at one end.

Within the framework of this invention, articles in the tobacco-processing industry are understood to include products such as cigarettes, filters, filter plugs, filter cigarettes, and the like.

A transfer device for rod-shaped articles is known from German Patent No. 31 37 223, which corresponds to U.S. Pat. No. 4,506,779.

In some filter-attachment machines, the individual components necessary for producing filter cigarettes, such as filter rods and cigarettes, are guided in peripherally suctioning grooves of rotating conveying rollers. The division of the grooves or receptacles in specific regions of the filter-attachment machine is based on parameters such as the cigarette machine cycle and the rod feeding cycle.

The transfer device for rod-shaped articles, known from the above-reference U.S. Patent, consists of two simultaneously rotating conveying cylinders, which are respectively provided along the periphery with differently divided inserts for the articles, as well as a conveying cylinder for the transition. The transition cylinder, which rotates in the opposite direction and is positioned between the conveying cylinders functions to remove the articles from the cylinders or deposits them on the cylinders at defined transfer locations. For this purpose, a plurality of end pieces designed as levers are provided, each having one arm with an insert for the articles. The transition cylinder furthermore is provided with a second rotating member which rotates in the same direction and with the same angular speed as the first rotating member around an axis that is separate from and parallel to the axis of the first rotating member. In this construction, connecting means with separate rods are provided between the second rotating member and each lever-type end piece for joining the respective lever-type end piece and the second rotating member. To permit synchronization with the circumferential speeds, the levers are pivoted to the transfer position prior to picking up the respective article and are then pivoted away from it. Thus, the speed is initially reduced to obtain a relative speed of zero between the transfer elements. To deposit an article onto a conveying roller that rotates faster, the operational steps are reversed and the respective lever is used to adapt the speed of the article to be transferred to the speed of the conveying roller that will accommodate the article. The structure disclosed in the above-referenced U.S. Pat. No. 4,506,779 is not suitable for the separation of articles in the tobacco-processing industry. Furthermore, the conventional device has a type of planetary gear as a drive which is subject to relatively high wear and is susceptible to failure.

SUMMARY OF THE INVENTION

In contrast to the known methods and arrangements described above, it is an object of the present invention to provide a device that can separate or stagger articles in, for example, the tobacco-processing industry. In the process, the separation or staggering should occur relatively quickly and the device should be subject to low wear and thus require low maintenance. Furthermore, it is an object of the present invention to provide methods for transferring articles in, for example, the tobacco-processing industry, by means of which the articles can be separated or staggered and which permits a fast process control.

This object is achieved with a method according to the invention that transfers articles in, for example, the tobacco-processing industry from a first conveying device to a second conveying device. For this purpose, the transfer device is provided with transfer elements, arranged one behind the other in a circumferential direction. The transfer elements are pivoted and have one receptacle for each article, wherein at least two transfer elements are arranged with an axial offset to each other.

With a transfer device according to the invention, it is possible to quickly stagger articles and transfer the articles from one conveying device to another. In particular embodiments of this invention, a transfer element comprises an arm or a rod. The transfer device and the conveying devices are preferably drums, wherein the first conveying device is preferably a feeding roller and the second conveying device is preferably a removal drum.

For the purpose of this description, "at an axial offset relative to each other" is understood to mean an offset or an arrangement for which the transfer elements are arranged at an offset in the direction of the rotational axis for the transfer elements (provided they have a rotational axis), the axial direction of the respective receptacles for the transfer elements, or the axial direction of rod-shaped articles held inside the receptacles.

In one preferred embodiment, the receptacles for a first conveying device are divided so as to be relatively close together while the receptacles of the second conveying device are spaced relatively far apart. It is preferable that the divisional spacing between the receptacles can be changed. This is made possible by the pivoting ability of the transfer elements, which are arranged one behind the other in circumferential direction and are offset relative to each other in an axial direction. These terms in particular must be understood to mean that the at least two transfer elements having an axial offset define at least two planes, in which successively positioned transfer elements are arranged. From the perspective of FIGS. 1 and 2 of this application, two planes of successively arranged transfer elements are arranged offset in an axial direction, wherein respective pairs of transfer elements—two transfer elements in the examples shown in the Figures—are arranged with an axial offset. However, the plane and the Figures can be viewed from the side as well as from the top. For that reason, the terms "one behind the other" and "at an axial offset" should not be viewed as limiting. "At an axial offset" in particular means crosswise to the movement plane of the transfer device and "one behind the other" in the movement plane for the transfer device.

The at least two transfer elements arranged with an axial offset preferably are independent of each other and, in particular, can be pivoted differently. By means of such an arrangement, a very effective separation or staggering of the articles to be transferred may be achieved. Preferably at least two articles arranged one above the other, or axially aligned, are provided in the receptacles of the first conveying device. These articles are either divided just before the transfer into two articles, from one article of double the usable length, or they are divided into two articles during or shortly after the transfer.

A transfer device that is exposed to low wear can be realized if the transfer elements with respective axial offset preferably define planes, wherein one cam body per plane is provided for pivoting the transfer elements of a plane assigned to the cam body.

The transfer device preferably comprises a rotating drum, which permits a particularly simple embodiment of the invention. A rapid transfer can be realized if at least one cam body is designed such that during a movement of the transfer elements toward a first transfer station, in which articles can be picked up by transfer elements of the transfer device, the transfer elements can be pivoted in the rotational direction or in the direction of the first transfer station. In particular, it is possible to provide a larger division spacing between the receptacles of the transfer device as compared to the receptacles of the first conveying device. The division spacing which is understood to be the distance between two receptacles, can be a whole-number multiple of $\pi$. As a result of the pivoting ability of the transfer elements on the transfer device, a variable division spacing or a variable spacing between the receptacles of successively arranged transfer elements or the axially offset transfer elements is possible.

The at least one cam body is preferably designed such that the transfer elements can be pivoted in a counter-rotational direction following the transfer in the first transfer station. As a result of this measure, the articles can be transferred to the second conveying device which itself has a larger division spacing than the first conveying device. If the cam bodies of a preferred embodiment are designed such that, at least in part, an asynchronous movement of the transfer elements is possible, it is easy to convey and transfer rod-shaped articles from a predetermined division spacing of the first conveying device to a different division spacing of the second conveying device. A particularly fast transfer is possible if the at least one transfer element during its movement toward a second transfer station, where the articles can be deposited by the transfer elements, is pivotal in the direction toward the second transfer station, thus permitting a staggering of the articles.

A particularly elegant embodiment results if the cam bodies assigned to the planes have identical shapes, at least in the region of the first transfer station. A synchronous movement of the transfer elements, arranged one above the other, or the pairs of transfer elements is possible as a result.

If the cam bodies are preferably designed such that they permit a pivoting of the axially offset transfer elements in different directions, at least in the region of a second transfer station, a particularly effective staggering of the at least two axially aligned articles located in the receptacles of the first conveying device is possible. In the case of two axially aligned articles, the transfer elements are pulled apart in a rotational direction in the region of the second transfer station. With three axially aligned articles, for example, the center transfer element can be arranged radially to the drum center, provided the transfer device is a drum. The two additional transfer elements are then pivoted, in the movement direction, in front of and behind the center transfer element.

An object of the invention is further achieved with a device for staggering rod-shaped articles. The device comprises at least one conveying device with receptacles for at least two axially aligned, rod-shaped articles and a second conveying device with receptacles for one rod-shaped article. The staggering device is modified in that a transfer device is provided between the first conveying device and the second conveying device, with transfer elements for accommodating the two axially aligned articles and for the staggered release of the articles. The two axially aligned articles are picked up in the region of a first transfer station and are released in the region of a second transfer station. The first conveying device preferably is a feeding roller, the second conveying device is a removal roller and the transfer device preferably is a circulating endless conveyor. It is furthermore advantageous if the conveying devices as well as the circulating endless conveyor are drums.

A preferred embodiment provides for an alignment device for the lateral axial alignment of the articles deposited into the second conveying device. This alignment device is preferably provided in the region of the second conveying device and is a wall, for example, which can be made to interact with the articles, so as to align them. The transfer device of the staggering device is preferably designed as described above.

A machine for producing elongated products is advantageously provided with at least one transfer device and/or one staggering device of the above-described type. The transfer device finds particular use in a MAX machine manufactured by Hauni Maschinenbau AG. A MAX machine, provided accordingly with a transfer device according to the invention, preferably could be used for producing multiple-segment filters. The transfer device could furthermore be used in filter production machines for producing multiple-length filters. Hauni Maschinenbau AG's MULFI machine, for example, is a machine of this type. Multiple-length filters are understood to be filters consisting of at least two filter rods or filter plugs, arranged one behind the other in an axial direction.

According to the invention, several transfer element groups, arranged one behind the other in a circumferential direction of a transfer device, are used for transferring rod-shaped articles in the tobacco-processing industry. Each group comprises at least two pivoting transfer elements offset along an axis that is common to the elements in the group. The transfer element groups can also be pairs of transfer elements, wherein two or more articles can be transferred with the transfer element group. The transfer element groups are used particularly to transfer articles in the tobacco-processing industry from one drum to another drum and preferably function to stagger and further separate the articles accordingly.

It is preferable if the transfer elements of a group can be pivoted independently of each other.

The invention further comprises a method for transferring rod-shaped articles in the tobacco-processing industry from the receptacles on a first conveying device to the receptacles on a second conveying device by using transfer elements that are provided with a receptacle at each end.

The method includes conveying the articles in the receptacles of the first conveying device to the region of a first transfer station and transferring the articles into the receptacles of the transfer elements, which are located in the region of the first transfer station. The articles are then conveyed to the region of a second transfer station and transferred into the receptacles of the second conveying device. During the transfer of the articles in the first transfer station, at least two axially aligned articles are transferred to at least two transfer elements offset along a common axis and, for the transfer of the articles to the second conveying device, the receptacles of the axially aligned transfer elements are moved away from each other.

Methods according to the invention permit fast process control for staggering articles in, for example, the tobacco-processing industry. A particularly fast transfer and adaptation to the second conveying device is possible if the receptacles that are moved away from each other are moved to a distance from each other that corresponds to the division spacing for the receptacles of the second conveying device. The receptacles of the transfer elements, which are moved away from each other, are preferably moved toward each other when moving the receptacles of the transfer elements, arranged at an axial offset, toward the first transfer station until these are aligned. This modification according to the invention permits a particularly secure takeover of the articles from the first conveying device.

The articles are preferably transferred to receptacles that are adjacent in a circumferential direction of the second conveying device. If the articles to be transferred to the second conveying device are subsequently aligned in lateral axial direction, they can easily be used further in, for example, a filter-attachment machine. For example, they can be placed between two tobacco stock sections that are wrapped in cigarette paper.

Particular embodiments of the invention include a transfer device for transferring articles from a first conveying device to a second conveying device. The device has a central body and a plurality of transfer element sets attached to the central body. Each transfer element set has a plurality of pivoting transfer elements, each transfer element having a receptacle for receiving an article. The plurality of transfer element sets are arranged around a perimeter of the central body. A first pivoting transfer element and a second pivoting transfer element within one of the transfer element sets are axially offset relative to each other along a common axis.

Other embodiments of the invention include a staggering device for staggering rod-shaped articles. The device has a first conveying device having first receptacles, each first receptacle holding at least two axially aligned rod-shaped articles, and a second conveying device having second receptacles, each second receptacle holding one of the rod-shaped articles. The device also has a transfer device provided between the first conveying device and the second conveying device. The transfer device has transfer elements for holding the at least two axially aligned articles and for staggering the release of the articles.

Other embodiments of the invention include the use of a plurality of transfer-element groups, arranged one behind the other in a circumferential direction of a transfer device, for transferring rod-shaped articles in the tobacco-processing industry. Each of the transfer-element groups has at least two pivoting transfer elements which are arranged with an axial offset relative to each other.

Other embodiments of the invention include a method for transferring rod-shaped articles from receptacles of a first conveying device to receptacles of a second conveying device. The method includes conveying at least two axially aligned articles in the receptacles of the first conveying device into a first transfer station, and transferring the at least two axially aligned articles into respective receptacles of transfer elements which are located in the first transfer station and which are axially offset relative to one another along a common axis. The method also includes conveying the articles into a second transfer station and transferring the articles into the receptacles of the second conveying device by moving the receptacles of the at least two transfer elements away from each other.

Other embodiments of the invention include a transfer device for transferring rod-shaped articles from receptacles of a first conveying device to receptacles of a second conveying device. The device includes means for conveying at least two axially aligned articles in the receptacles of the first conveying device into a first transfer station, and means for transferring the at least two axially aligned articles into receptacles of transfer elements located in the first transfer station and axially offset relative to one another along a common axis. The device also includes means for conveying the articles into a second transfer station and means for transferring the articles into the receptacles of the second conveying device by moving the receptacles of the at least two transfer elements away from each other.

BRIEF DESCRIPTION OF THE DRAWINGS

The invention is described in the following without restricting the general inventive idea and with the aid of exemplary embodiments by referring to the drawings, where like reference numbers represent like elements and where.

DETAILED DESCRIPTION OF PREFERRED EMBODIMENTS

Figure 1:
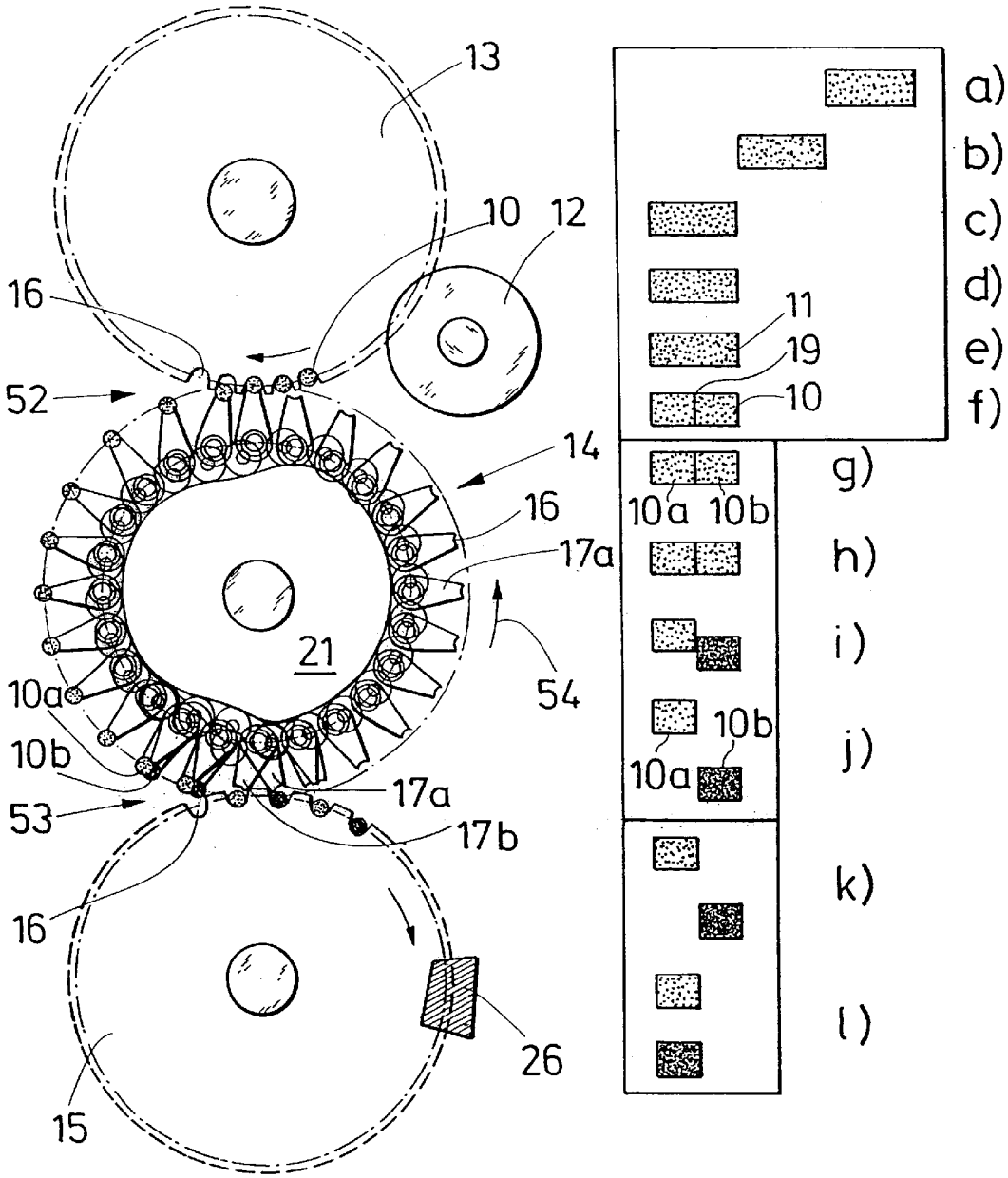
FIG. 1 shows a schematic top plan view of the three drums, as well as the relative positioning of corresponding filter plugs in the region on the right.

A top plan view of three drums 13, 14 and 15 is shown in the left region of FIG. 1, wherein the center drum is designed to show schematically a transfer device according to the invention. Filter plugs 10, obtained by using a circular blade 12 to make a cut 19 through a double-length filter plug 11, are moved in the receptacles 16 of a conveying drum 13. Only five of the receptacles distributed over the conveying drum 13 are shown in FIG. 1. The conveying drum 13 preferably has receptacles 16 distributed over the entire circumference. The receptacles 16 each accommodate two filter plugs 10, positioned one above the other. In the movement direction shown with an arrow, double-length filter plugs 11 are held inside the receptacles in front of the circular blade 12. Double-length filter plugs 11 are understood to be filter plugs with double the usable length. The circular blade 12 cuts these double-length filter plugs 11 into two filter plugs 10.

Suction air is used to hold the filter plugs or double-length filter plugs inside the receptacles. In the first transfer region 52, the two filter plugs 10 that are arranged one above the other are transferred into receptacles 16 of superimposed pivoting arms 17*a* and 17*b* of a transfer drum 14. Here too, suction air is used to hold the filter plugs 10 inside the receptacles. The two filter plugs 10 are subsequently conveyed in a rotational direction 54 to a second transfer region 53. Initially, the movement of the two pivoting arms 17*a* and 17*b*, and thus the movement of the upper filter plugs 10*b* and the lower filter plugs 10*a*, is the same. In the lower region of transfer drum 14, the upper pivoting arm 17*b* and the lower pivoting arm 17*a* pivot in different directions, so as to permit an intervention and transfer of the filter plugs 10*a* and 10*b* into adjacent receptacles 16 of an alignment or staggering drum 15. This operation will be described in further detail in reference to FIG. 2.

The right side of FIG. 1 schematically shows the relative position of the double-length filter plugs 11 and the filter plugs 10. A double-length filter plug 11 is shown still relatively high up in position a) at far right in FIG. 1. In the further course of supplying the double-length filter plug 11 to the region of the circular blade 12, the plug 11 is conveyed to the processing and cutting plane. In position f), a cut 19 has already been made to the double-length filter plug 11 to create two filter plugs 10, namely an upper filter plug 10*b* and a lower filter plug 10*a*. The distance between the filter plugs is increased between position g) and position h). In position i), the two filter plugs 10 have already been pivoted to some degree. The maximum pivoting occurs at position j). Position k) shows that the two filter plugs 10 are arranged at a distance from each other which corresponds to the division spacing of the receptacles 16 in the alignment drum 15. In position l), the two filter plugs are arranged sequentially in a row and vertically aligned. The vertical alignment can be performed by an alignment device 26.

Figure 2:
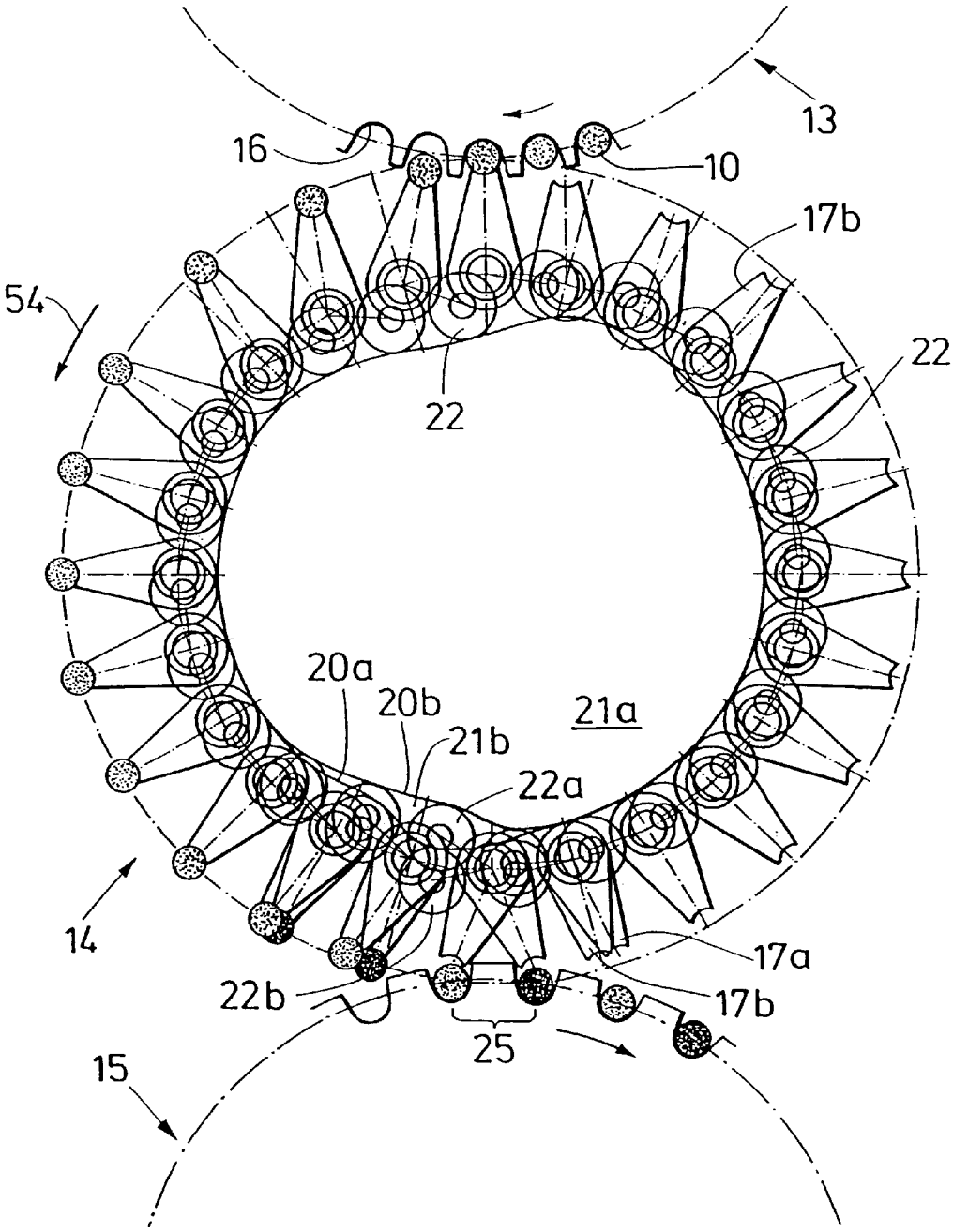
FIG. 2 shows an enlarged detail of FIG. 1.

The transfer operation and the transfer drum 14 are shown in further detail in FIG. 2. In particular, this Figure shows that the pivoting arms 17*a* and 17*b* are coupled with the respective (pot-shaped dual-surface) cam bodies 21*a* and 21*b* via followers 22*a* and 22*b*. The cam tracks 20*a* and 20*b* essentially coincide, so that a parallel pivoting of the pivoting arms 17*a* and 17*b* is ensured for a large portion of the movement of transfer drum 14.

The frontal cam track 20*b* differs from the rear cam track 20*a* only in the lower region of FIG. 2, so that the pivoting arms perform different pivoting movements. The division of the alignment drum 15 is shown with reference number 25. The division spacing here is, for example, 6 $\pi$, whereas the division spacing for conveying drum 13 is, for example, 4 $\pi$. The division spacing for the transfer drum 14 is 8 $\pi$ on the average. For example, the transfer drum 14 rotates at approximately 210 rotations/minute while the followers 22*a*, 22*b* rotate at 1,600 rotations/minute. A lever arm 39 connects the followers 22*a* and 22*b* in the center with the turning center of pivoting arms 17*a* and 17*b*.

Figure 3:
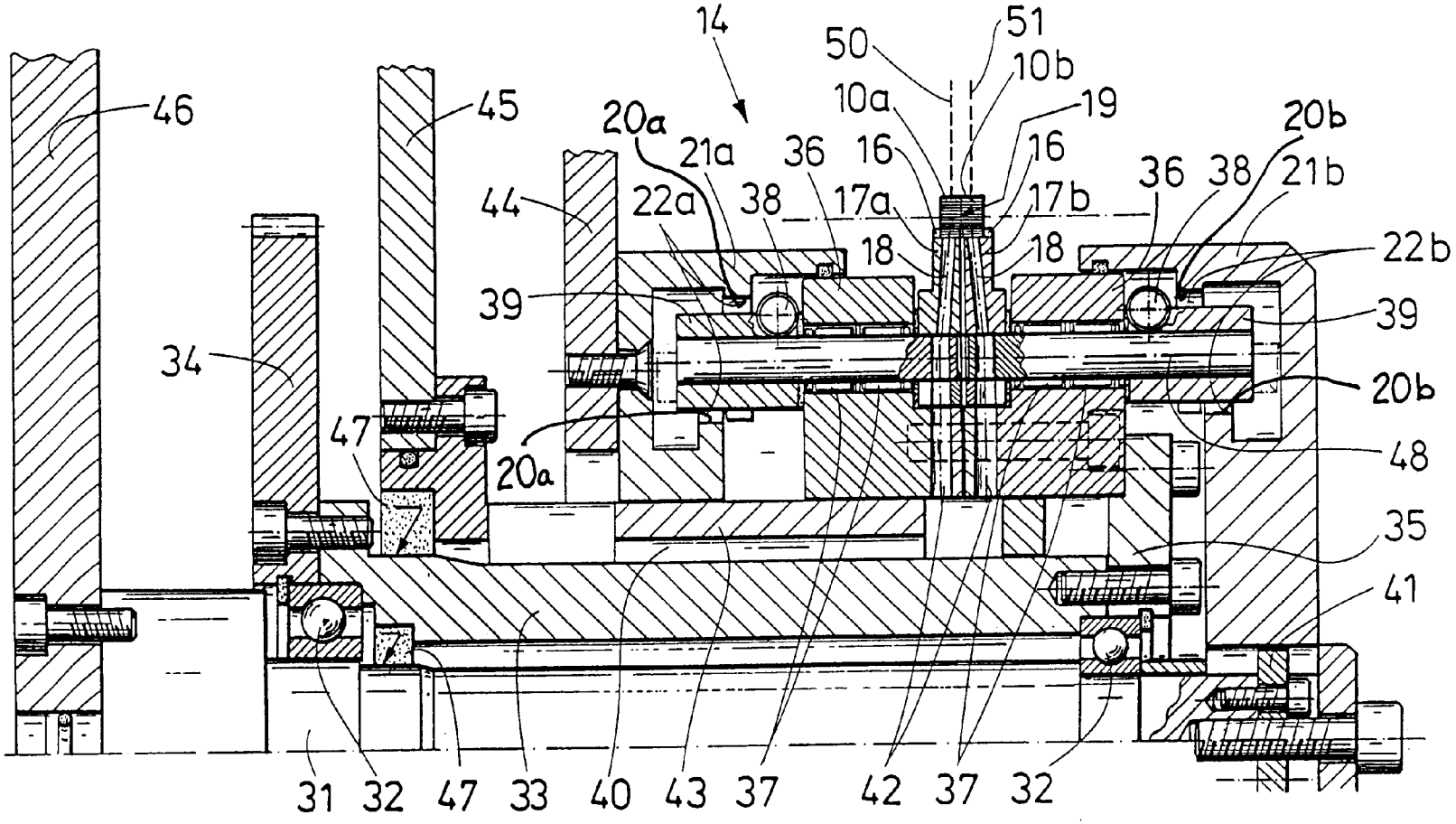
FIG. 3 shows an axial-sectional view of a staggering drum according to the invention.

FIG. 3 shows an axial section of the transfer drum 14. A hub 33 with a bearing arrangement 32 and a drive element 34 are arranged so as to rotate on a bearing stub 31. A connecting flange 35 concentrically couples two drum bodies 36 in a mirror image relationship. The pivoting arms 17*a* and 17*b* are arranged concentrically and uniformly spaced and are positioned on roller bearings inside the drum bodies 36. Lever arms 39 with followers 22*b* for the frontal cam track, and followers 22*a* for the rear cam track, are located on a second shaft end of the pivoting arms 17*a* and 17*b*. The necessary pivoting movements of the pivoting arms for the product takeover and the product transfer is initiated via the cam tracks 20*a* and 20*b* of the cam bodies 21*a* and 21*b*. The cam body 21*b* can be aligned with the cam body 21*a* by means of an adjustable cam track arresting device 41.

The holding force required for the transport is created with a vacuum. For this purpose, suction channels 18 are provided which connect the product, meaning the filter plugs 10*a* and 10*b* for this exemplary embodiment, to the suction side of a suitable fan. In the regions of the product takeover and product transfer, the suction air bore 42 is closed or opened and the airflow is turned on or off with the aid of the suction-air control member 43 and ring gap 40. The lid 44 for the air box, the lid 45 for the gearbox and the mounting plate 46 are used to form a sealed, self-lubricating drive housing and serve as an external air guide. In addition, seals 47 are provided for sealing in the suction air or vacuum. Bearings 37 are also provided, on which the respective, and thus adjacent, elements are positioned. The lever arms 39 can be fastened with the aid of clamping screws 38.

Figure 4A:
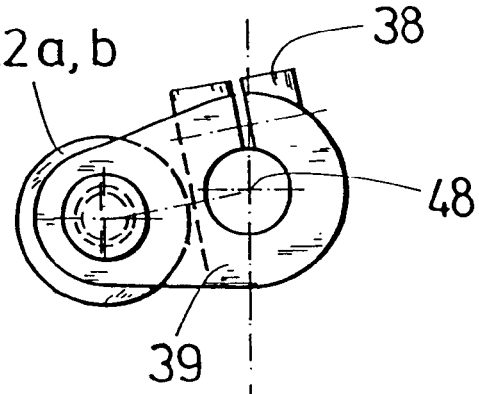
FIG. 4*a* shows a schematic side elevation view of a lever arm with cam rollers.

FIG. 4*a* shows a schematic view from the side of a lever arm 39 with respective followers 22*a* and 22*b*.

Figure 4B:
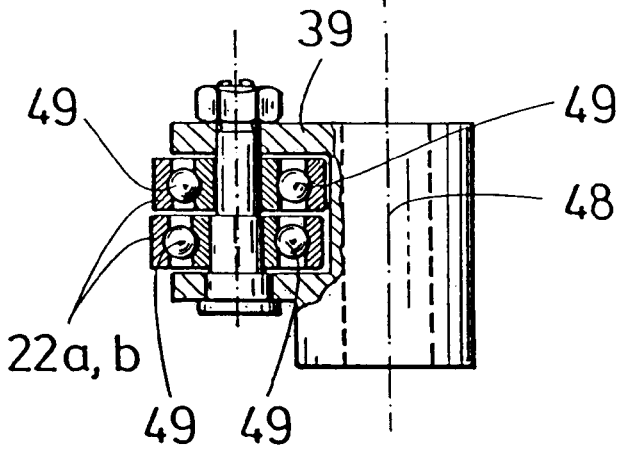
FIG. 4*b* shows a schematic, partially broken away, top plan view of the elements shown in FIG. 4*a*.

FIG. 4*b* shows a view from below of the element in FIG. 4*a*. It is seen that the followers 22*a* and 22*b* are arranged with a slight axial offset. In addition, ball bearings 49 are shown, around which the followers 22*a* and 22*b* rotate. The axis 48 is furthermore shown in FIG. 4*a* as well as FIG. 4*b*.

In recapitulation, to transfer cut rods and cigarettes or filter plugs with double the usable length from a drum with small division spacing to a drum with changeable division spacing, receptacle pairs 16 of the last-mentioned drum are pivoted in the rotational direction while moving in the direction of rod takeover. Each receptacle 16 of the receptacle pairs is positioned in either the first plane 50 or the second plane 51. Following the takeover, they are pivoted counter to the rotational direction of the drum, until the rod-shaped articles have been removed completely from the receptacle openings of the drum having the small division. Subsequently, the receptacle pairs are pivoted in the rotational direction of the drum until they are radially aligned with the takeover drum. The receptacles of the receptacle pairs are pivoted relative to each other in the counter rotational direction for transferring the rods with a single usable length to a second conveying drum. The pivoting continues until the spacing for the rods corresponds to the division spacing of the second conveying drum (alignment drum) 15. The rods are then transferred to the alignment drum.

The invention has been described in detail with respect to preferred embodiments and it will now be apparent from the foregoing to those skilled in the art that changes and modifications may be made without departing from the invention in its broader aspects. The invention, therefore, is intended to cover all such changes and modifications that fall within the true spirit of the invention.

What is claimed is:

1. A transfer device for transferring articles from a first conveying device to a second conveying device, comprising:

a central body; and a plurality of transfer element sets attached to the central body, each transfer element set comprising a plurality of pivoting transfer elements including first and second transfer elements, wherein each transfer element has a receptacle for receiving an article, the plurality of transfer element sets are arranged around a perimeter of the central body, and the first transfer element and the second transfer element within one of the transfer element sets are axially offset relative to one another along a common axis.

2. The transfer device according to claim 1, wherein the first and second transfer elements are pivotal independently of each other.

3. A method of transferring articles in the cigarette processing industry, comprising utilizing the transfer device according to claim 1.

4. The transfer device according to claim 1, wherein each pivoting transfer element set further comprises a common axle for defining the common axis.

5. The transfer device according to claim 1, wherein the central body comprises a rotating drum.

6. The transfer device according to claim 5, wherein the transfer element sets are arranged one behind the other in a circumferential direction of the drum.

7. The transfer device according to claim 1, further comprising a plurality of cam bodies, wherein each of the first and second transfer elements define a different plane, respective cam bodies are associated with each of the different planes, the first transfer element is pivoted by interaction with a first one of the cam bodies, and the second transfer element is pivoted by interaction with a second one of the cam bodies.

8. The transfer device according to claim 7, wherein the first and second cam bodies are shaped such that they cause asynchronous movement of the first and second transfer elements.

9. The transfer device according to claim 8, wherein the first and second cam bodies are shaped such that one of the first and second transfer elements is pivoted toward a second transfer station as the first transfer element is moved toward the second transfer station, the second transfer station being where the transfer element transfers the article to the second conveying device.

10. The transfer device according to claim 7, wherein the first cam body is shaped such that it causes the first transfer element to pivot toward a rotation direction of the central body as the first transfer element is moved toward a first transfer station, the first transfer station being where the first transfer element receives the article.

11. The transfer device according to claim 9, wherein the first cam body is shaped such that it causes the first pivoting transfer element to pivot counter to the rotation direction of the central body as the first transfer element receives the article at the first transfer station.

12. The transfer device according to claim 10, wherein the first and second cam bodies have identical shapes in a region of the first transfer station.

13. A staggering device for staggering rod-shaped articles, comprising:

a first conveying device having first receptacles, each first receptacle for holding at least two axially aligned rod-shaped articles;

a second conveying device having second receptacles, each second receptacle for holding one of the rod-shaped articles; and a transfer device provided between the first conveying device and the second conveying device, the transfer device having transfer elements for holding the axially aligned articles and pivoting along a common axis for staggering a release of the articles.

14. The staggering device according to claim 13, further comprising an alignment device for laterally aligning the articles deposited into the second conveying device.

15. The staggering device according to claim 13, wherein the transfer device further comprises a central body; and a plurality of transfer element sets attached to the central body, each transfer element set comprising a plurality of the transfer elements including first and second transfer elements, wherein each transfer element has a receptacle for receiving an article, the plurality of transfer element sets are arranged around a perimeter of the central body, and the first transfer element and the second transfer element within one of the transfer element sets are spaced along the common axis.

16. A machine for producing rod-shaped articles in the tobacco-processing industry, comprising:

at least one staggering device having a first conveying device having first receptacles, each first receptacle for holding at least two axially aligned rod-shaped articles;

a second conveying device having second receptacles, each second receptacle for holding one of the rod-shaped articles; and a transfer device provided between the first conveying device and the second conveying device, the transfer device having transfer elements for holding the axially aligned articles and pivoting along a common axis for staggering a release of the articles.

17. A method for transferring rod-shaped articles from receptacles of a first conveying device to receptacles of a second conveying device, the method comprising:

conveying at least two axially aligned articles in the receptacles of the first conveying device into a first transfer station;

transferring the at least two axially aligned articles into respective receptacles of transfer elements which are located in the first transfer station and which are axially offset relative to one another along a common axis;

conveying the articles into a second transfer station; and transferring the articles into the receptacles of the second conveying device by moving the receptacles of the at least two transfer elements away from each other.

18. The method according to claim 17, including moving the receptacles of the at least two transfer elements toward each other until they are aligned as the receptacles of the at least two transfer elements approach the first transfer station.

19. The method according to claim 17, wherein the receptacles of the second conveying device are arranged in a circumferential direction of the second conveying device.

20. The method according to claim 17, further comprising subsequently laterally aligning the articles transferred to the second conveying device.

21. The method according to claim 17, including moving the receptacles of the at least two transfer elements to be at a distance from each other that substantially corresponds to a division spacing of the receptacles of the second conveying device.

22. A transfer device for transferring rod-shaped articles from receptacles of a first conveying device to receptacles of a second conveying device, the device comprising:

means for conveying at least two axially aligned articles in the receptacles of the first conveying device into a first transfer station;

means for transferring the at least two axially aligned articles into respective receptacles of transfer elements located in the first transfer station and axially offset relative to each other along a common axis;

means for conveying the articles into a second transfer station; and means for transferring the articles into the receptacles of the second conveying device by moving the receptacles of the at least two transfer elements away from each other.

* * * * *